US006171004B1

(12) United States Patent
Derhammer

(10) Patent No.: US 6,171,004 B1
(45) Date of Patent: Jan. 9, 2001

(54) CLEANING APPARATUS

(76) Inventor: Jennifer Derhammer, 8522 Ryan Rd., Seville, OH (US) 44273

( * ) Notice: Under 35 U.S.C. 154(b), the term of this patent shall be extended for 0 days.

(21) Appl. No.: 09/304,176

(22) Filed: May 3, 1999

(51) Int. Cl.[7] ..... A47B 11/04

(52) U.S. Cl. ..... 401/8; 401/184; 401/186; 401/188 R; 401/196; 401/205; 401/207; 401/263; 401/266

(58) Field of Search ..... 401/8, 130, 145, 401/185, 186, 184, 188 R, 204, 205, 207, 196, 263, 266, 267, 197

(56) References Cited

U.S. PATENT DOCUMENTS

| | | | | |
|---|---|---|---|---|
| 307,877 | * | 11/1884 | Stevens | 401/184 |
| 551,764 | * | 12/1895 | Haynes | 401/184 X |
| 1,485,126 | * | 2/1924 | Schumacher | 401/185 X |
| 1,599,708 | * | 9/1926 | Gedge | 401/207 X |
| 1,691,024 | * | 11/1928 | Gedge | 401/205 X |
| 1,921,901 | * | 8/1933 | Anderson | 401/197 X |
| 2,537,784 | * | 1/1951 | Nord | 401/205 |
| 2,814,817 | * | 12/1957 | Ducker | 401/207 X |
| 3,128,493 | * | 4/1964 | Paul | 401/184 |
| 3,545,875 | * | 12/1970 | Schneider | 401/197 |
| 4,171,171 | * | 10/1979 | Jones | 401/196 X |
| 4,822,194 | * | 4/1989 | Simonette | 401/197 X |
| 4,971,471 | * | 11/1990 | Sloan | 401/140 X |

* cited by examiner

*Primary Examiner*—Henry J. Recla
*Assistant Examiner*—Kathleen J. Prunner
(74) *Attorney, Agent, or Firm*—Christropher L. Parmelee; Ralph E. Jocke

(57) ABSTRACT

A hand held cleaning apparatus for cleaning small jobs that includes a supply of cleaning fluid. The apparatus (10) includes a body (12) with a reservoir (13) for storing a supply of a cleaning fluid (15). The body includes an opening (17) that is sealed with a removable cap (16). The cap includes a loop portion (18) that can be used to hang the apparatus on a hook or other protrusion for storage. The body is in operative connection with a cleaning head (14). The cleaning head includes a scrubber (22) comprised of an absorbent material such as a sponge. The scrubber is secured to the cleaning head with a holder tube (26) that extends through a bore (24) in the interior of the scrubber. The cleaning head further includes a fluid pathway (28) between the reservoir and the holder tube that allows fluid to flow from the reservoir into the holder tube. The holder tube includes a plurality of apertures that allow fluid to flow out of the holder tube and into the scrubber. The body of the cleaning apparatus includes an movable member (20). The movable member includes a flexible membrane (11) that covers an opening (21) in the body. When the movable member is pushed, fluid from the reservoir is forced through the pathway, out of the apertures in the holder tube and into the scrubber.

19 Claims, 5 Drawing Sheets

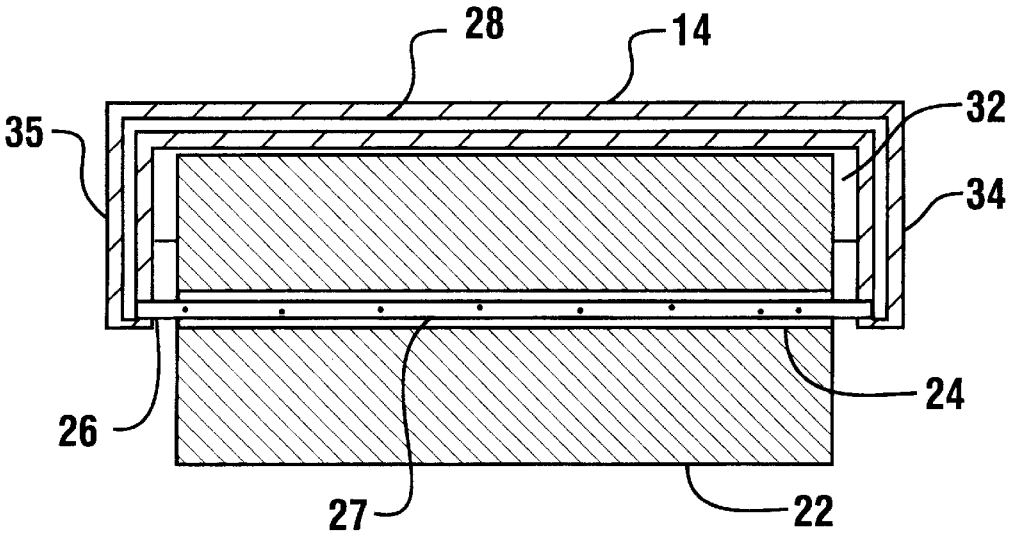
FIG. 3
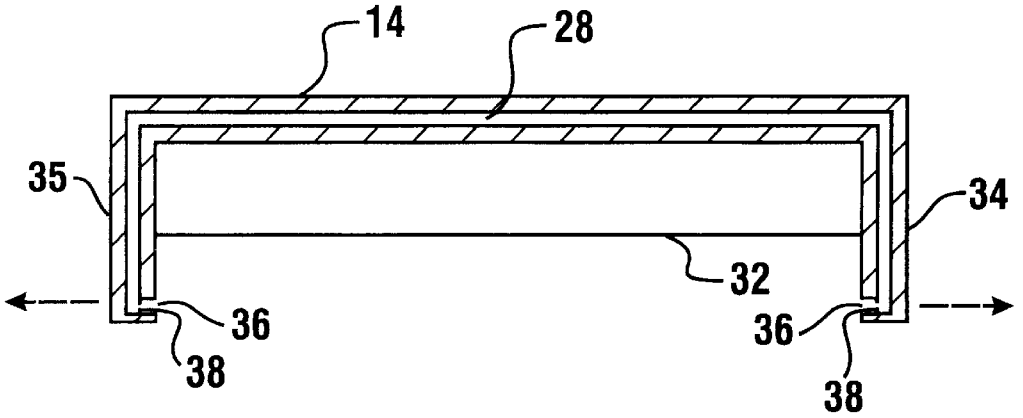
FIG. 4
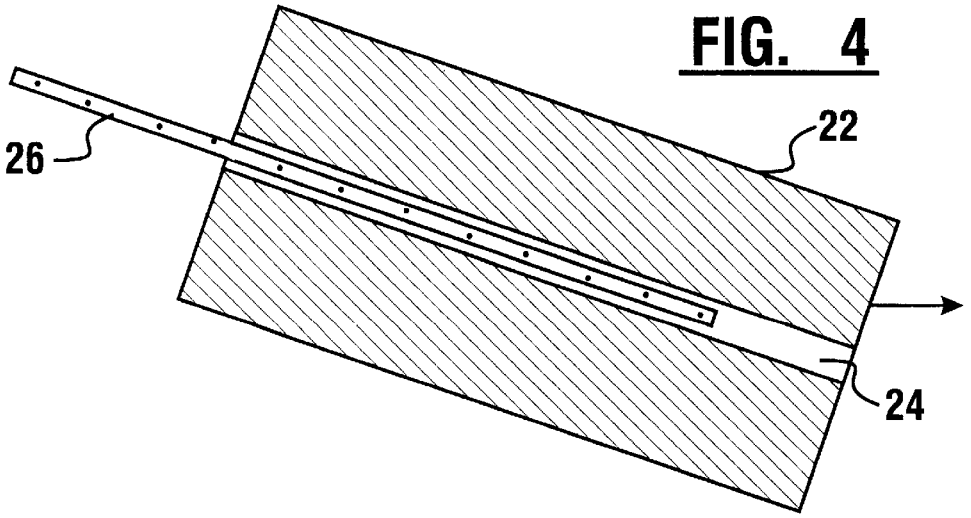

CLEANING APPARATUS

TECHNICAL FIELD

This invention relates to a new cleaning apparatus. Specifically this invention relates to a cleaning apparatus for cleaning various surfaces.

BACKGROUND ART

Current cleaning devices for floors and other surfaces, such as mops, generally require the use of a bucket of cleaning fluid for soaking and rinsing a mop head. The mop head usually is comprised of fluid absorbing strands or a sponge type material. The typical mop includes a long rod-shaped handle that is used to push or pull the mop head along a floor by a standing person. Although cleaning a floor with a mop is efficient for large surfaces, the procedure of filling a bucket with diluted cleaning solvent, soaking a mop head in the bucket and wiping the floor with the mop head can be very time consuming. Additional time is required to dump the bucket of dirty water and to rinse the mop before the mop can be stored away. When only a small spill or stain needs to be cleaned, the mopping process is not very efficient. Typically such small spills or stains are cleaned with a rag or paper towel. However, using a rag or paper towel also requires wetting the rag with water or other cleaning fluid from a faucet or bucket. When the fluid in the rag has been consumed, the rag must be re-soaked. To eliminate the need for a bucket of cleaning fluid or to avoid repeatedly going to a faucet to wet down a rag, a spray bottle containing a cleaning fluid is typically used to directly soak the area to be cleaned before wiping with a rag.

Like a bucket, a spray bottle allows a person to clean an area that is not conveniently located near a fluid source such as a faucet. However as with mopping, two elements must be acquired (a spray bottle and a rag) before an area can be cleaned. Further as with many household items, a spray bottle may not be located anywhere near a clean rag, which requires a person to search for both items before a spill can be cleaned.

Mops as well as cloth rags are reusable. Paper towels on the other hand are discarded and are not reused. Although paper towels are very inexpensive by the sheet, continuous use of paper towels over time for cleaning surfaces does require purchasing a constant supply. In the long run paper towels can be more expensive when compared to reusable rags. However, for many people the additional cost of paper towels is justified by eliminating the extra time that is required to rinse out and hang dry a wet towel before it can stored away.

Consequently there exists a need for a device that is easier to use than a mop and bucket for cleaning small surfaces. There fuarther exists a need for a cleaning device that does not require the repeated wetting of a rag or paper towel in a bucket or at a faucet. There further exists a need for a cleaning device that does not require a surface to be pre-sprayed with a bottle of cleaning fluid. There further exists a need for a cleaning device that is reusable. There also exists a need for a cleaning device that is easily cleaned and easily stored away.

DISCLOSURE OF INVENTION

It is an object of the present invention to provide a cleaning apparatus that is easy to use for small cleaning jobs.

It is a further object of the present invention to provide a cleaning apparatus that is reusable.

It is a further object of the present invention to provide a cleaning apparatus that in itself is easily cleaned.

It is a further object of the present invention to provide a cleaning apparatus that is easily stored.

It is a further object of the present invention to provide a cleaning apparatus that does not require a separate bucket of cleaning fluid.

It is a further object of the present invention to a provide a cleaning apparatus that can clean a surface without spraying the surface with a cleaning fluid.

It is a further object of the present invention to provide a cleaning apparatus that includes a supply of cleaning fluid therein.

It is a further object of the present invention to provide a cleaning apparatus that can selectively wet a scrubbing element with an internally supplied fluid.

Further objects of the present invention will be made apparent in the following Best Modes for Carrying Out Invention and the appended claims.

The foregoing objects are accomplished in one preferred embodiment of the invention by a portable hand held cleaning apparatus with a body that includes a reservoir for holding a supply of cleaning fluid. The fluid is preferably water or a water based cleaning solvent, however, any fluid suitable for cleaning a surface is encompassed by the present invention. The body preferably has a cylindrical shape that is suitable for use as a handle. In the exemplary embodiment of the cleaning apparatus a first end of the body includes an opening that is sealed with a removable cap. When the cap is removed, a fluid can be placed into the reservoir at the opening.

A cleaning head is in operative connection with a second end of the body. The cleaning head preferably includes an scrubber such as a sponge or other porous material that is capable of absorbing a fluid. The scrubber includes a bore that extends between two disposed ends of the scrubber.

The cleaning head includes a fluid pathway that is in fluid communication with the reservoir and a removable holder tube, such that the fluid is operative to pass from the reservoir to the holder tube. The holder tube passes through a bore in the scrubber and is operative to hold the scrubber to the cleaning head. When the holder tube is removed from the cleaning head, the scrubber is freed from the cleaning head. The holder tube slides out of the bore, allowing the scrubber to be cleaned or replaced. The holder tube includes a plurality of apertures. Fluid flowing through the holder tube is operative to pass out of these apertures into the scrubber.

The cleaning apparatus also includes a movable member which is operative to cause fluid to move from the reservoir through the pathway, into the holder tube, out the apertures of the holder tube, and into the scrubber. In the preferred embodiment this movable member is operative to impart an increased pressure to the fluid inside the reservoir. This increased pressure causes a portion of the fluid to flow from the reservoir.

Thus a person can wet the scrubber by pushing the movable member one or more times. In the preferred embodiment the movable member is a small flexible convex shaped membrane that covers an opening in the body of the cleaning apparatus. When the membrane is pressed into the opening in the body by a person's finger, the volume of the reservoir decreases, forcing fluid to be injected into the scrubber. Once the scrubber is wet, the cleaning apparatus can be used to clean a surface. The injected cleaning fluid in the scrubber improves the cleaning ability of the apparatus for many types of cleaning jobs. However, the apparatus can also be used with the scrubber being dry for soaking up spilled liquids. In addition, the body of the apparatus is connected to the cleaning head at an angle to offer more leverage when wiping up stains, dirt, spilled liquids, or any other material that can be cleaned with a wet or dry absorbent material such as a sponge.

To clean the scrubber after multiple cleaning jobs, the scrubber slides away from the disengaged holder tube. The scrubber can then be washed in a sink or even a dishwasher.

Placing fluid in the reservoir allows the cleaning apparatus to clean areas away from a source of fluid. The cleaning apparatus includes a sufficient volume of liquid to adequately clean numerous small jobs. Unlike a traditional mop, a bucket is not required to wet the cleaning end. Unlike a traditional rag or paper towel, a spray bottle is not required to pre-wet the cleaning surface. Thus a dirty surface can be cleaned much faster with the apparatus of the present invention, because the cleaning apparatus includes its own supply of cleaning fluid.

BRIEF DESCRIPTION OF DRAWINGS

FIG. 3 is a cross-sectional front view representative of the scrubber positioned within the cleaning head.

FIG. 4 is a cross-sectional front view representative of the scrubber removed from the cleaning head.

BEST MODES FOR CARRYING OUT INVENTION

Figure 1:
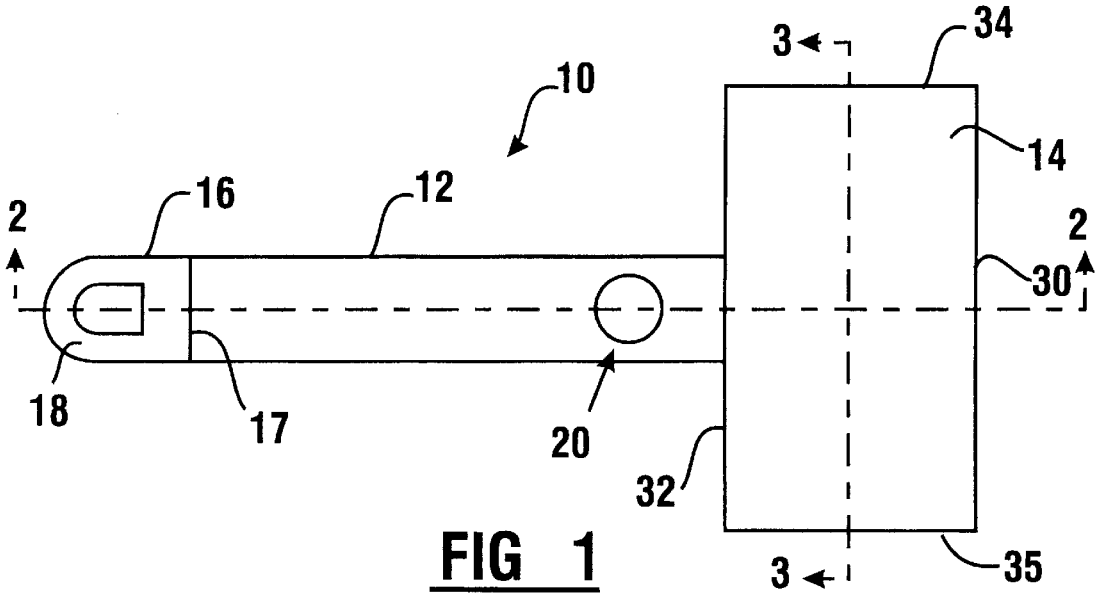
FIG. 1 is a top view representative of one preferred embodiment of a cleaning apparatus of the present invention.

Referring now to the drawings and particularly to FIG. 1, there is shown therein a top view representative of the cleaning apparatus 10 of an exemplary preferred embodiment. The cleaning apparatus 10 includes a hollow body 12. The body preferably has a shape of a cylinder to allow a person to grip the cleaning apparatus with one hand. The body may also include finger indentations, recesses or other structures to facilitate maintaining a firm grip of the body when the cleaning apparatus is used to clean heavily soiled areas.

The body 12 includes a first opening 17 that is shown being closed by a removable cap 16. The cap 16 in the described embodiment includes threads or other closure structures that are operative to releasibly engage the body and close and fluidly seal the opening 17. The body of the exemplary embodiment includes cooperating threads and other structures to accept and releasibly engage the cap. The cap 16 further includes a loop portion 18 that allows the cleaning apparatus 10 to be hung on a hook or other protrusion for storage of the apparatus.

Figure 2:
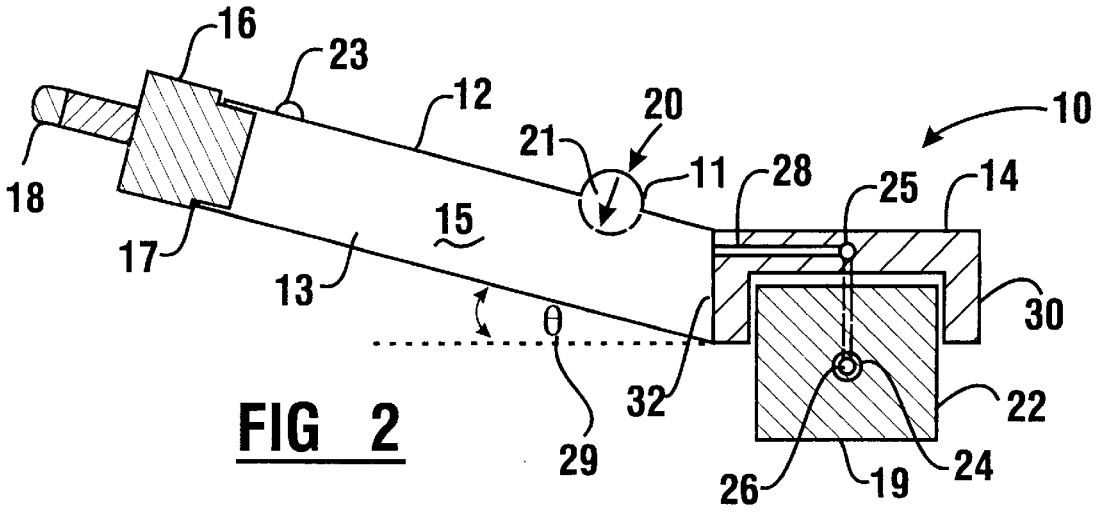
FIG. 2 is a cross-sectional side view representative of the cleaning apparatus of the present invention.

The body 12 is in operative connection with a cleaning head 14. The cleaning head 14 is a portion of the cleaning apparatus that is intended to come in contact with a surface to be cleaned. The cleaning head 14 includes four lateral sides 30, 32, 34, and 35. As shown in the cross-sectional side view of FIG. 2, the cleaning head 14 also includes a removable scrubber 22. In the, exemplary embodiment the scrubber 22 includes a synthetic sponge material. The scrubber includes a contact surface 19 which contacts surfaces to be cleaned using the cleaning apparatus. However, in alterative embodiments, the scrubber can be comprised of any absorbent or porous material that is capable of cleaning multiple surfaces with limited degradation to the material. The scrubber may further include additional internal or external structures for providing support thereto or fluid dispersion thereon or therein.

The body 12 of the exemplary embodiment extends at an angle generally indicated 29 to the contact surface 19 of the cleaning head 14. This angle 29 enables the user to apply forces more effectively and to achieve greater leverage from the body 12 for pushing the scrubber portion 22 of the cleaning head across a surface. The body 12 also in supporting connection therewith includes a reservoir 13 for storing a supply of a cleaning fluid 15. In the exemplary embodiment the reservoir is in the interior of the handle, but in other embodiments the reservoir may extend on the exterior thereof. The cleaning fluid is typically water. However, other types of cleaning fluids can be stored in the reservoir, including for example, ammonia, water based detergents, and other liquid cleaning products.

The cleaning head 14 includes a fluid pathway 28 that is in fluid communication with both the reservoir 13 and a holder tube 26. The holder tube 26 is preferably a removable hollow tube that passes inside a bore 24 in the scrubber 22. The ends of the holder tube are in releasable supporting connection with the side walls 34 and 35 of the cleaning head. The holder tube 26 is operative to hold the scrubber 22 in engagement with the cleaning head between side walls 34 and 35. The pathway 28 allows fluid to pass from the reservoir 13 to the holder tube 26.

The body 12 of the exemplary embodiment further includes an movable member 20. Movement of the movable member 20 causes fluid to move from the reservoir 13 through the pathway 28 into the holder tube 26. In the exemplary preferred embodiment the movable member 20 includes or is in connection with a flexible membrane 11 that covers a second opening 21 in the body 12 of the cleaning apparatus 10. When a person presses the movable member 20 toward the reservoir 13, the interior volume of the reservoir is decreased. The resulting increase in pressure causes fluid 15 to pass from the reservoir 13 through pathway 28 and into the holder tube 26. The flexible membrane 11 is preferably designed to have sufficient structural memory so that it will spring back into its normal convex orientation after being pressed inward. Alteratively, springs or other structures for returning the membrane to its extended position may be used. It should be understood that the flexible membrane pumping structure of the exemplary embodiment is but one of many possible movable member pumping devices that may be used in embodiments of the invention for pumping fluid from the reservoir 13 to the scrubber 22.

The apparatus may also have one or more air inlets that are operative to allow air to enter the reservoir 13 to normalize the internal pressure of the reservoir with atmospheric pressure after the flexible membrane 11 has been released and is returning to its normal convex form. In the exemplary embodiment an air inlet valve 23 which operates as a check valve enables air to pass into the reservoir as fluid is removed therefrom.

The cleaning apparatus of exemplary embodiments may also include a fluid valve 25 located in operative connection with the pathway 28. In the exemplary embodiment the fluid valve 25 is a pressure relief type valve that is operative to block fluid 15 from leaking out of the reservoir 13 when the apparatus is not in use. However, when the movable member 20 is pressed, the resulting pressure is sufficient to allow fluid from the reservoir to pass the fluid valve 25. Also when the movable member is released the fluid valve 25 is operative as a check valve to block fluid in the pathway from returning to the reservoir. In alternative embodiments manual or other or additional valves may be used to prevent fluid loss when the apparatus is not in use. Additional or other valve structures may also be used to prevent fluid from passing from the scrubber to the reservoir in response to pumping action and/or pressures developed by deformation of the scrubber when the apparatus is in use.

Figure 10:
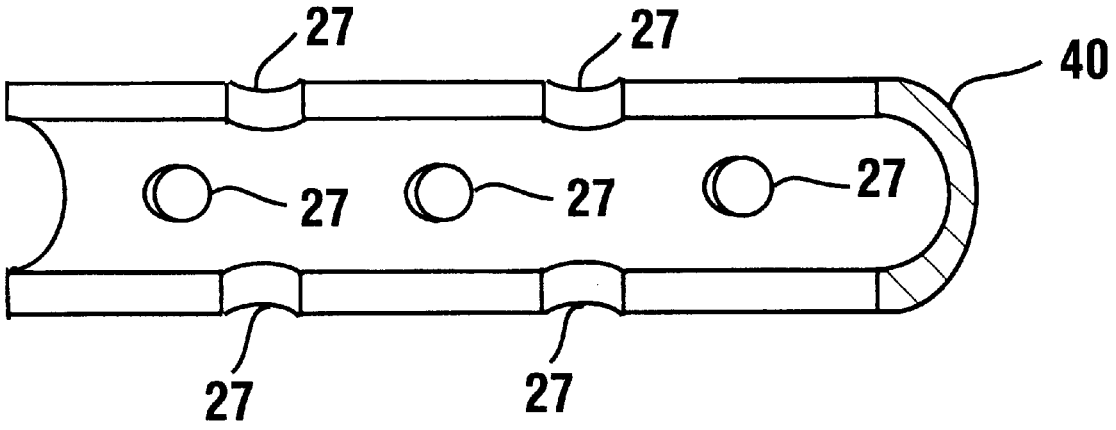
FIG. 10 is a cross-sectional side view representative of the holder tube in the preferred embodiment.

FIG. 3 is a cross section frontal view of the cleaning head 14. The holder tube preferably includes a plurality of apertures 27 along its entire length and surface. These apertures have diameters that preferably range between 0.5 and 2 millimeters in diameter. FIG. 10 shows a cross sectional view of the holder tube 26 with the plurality of apertures 27. Fluid that passes into the holder tube 26 when the movable member 20 is pressed passes out of the apertures 27 and adjacent the scrubber 22. In the exemplary embodiment the fluid is directed into the interior of the scrubber. However in other embodiments the fluid may be directed above or onto an exterior surface of the scrubber or onto the surface being cleaned.

Pressing the movable member 20 one or multiple times is operative to wet down the scrubber 22 with the cleaning fluid. Fluid is typically injected into the scrubber prior to cleaning a surface. However, for liquid spills, the cleaning apparatus can also be used without first injecting fluid into the scrubber. Instead the relatively dry scrubber can be used to absorb the liquid from a spill.

FIG. 4 shows the cleaning head 14 with the holder tube 26 disengaged from the cleaning head. The side walls 34 and 35 of the cleaning head 14 preferably include holding notches 36 that are operative to hold the holder tube in place in the cleaning head. In one exemplary embodiment the holder tube 26 is comprised of a plastic or other material that bends sufficiently to allow an end of the holder tube to be removed from one of the holding notches 36. The holder tube 26 is of sufficient resilience and rigidity to spring back and engage the notches 36. The engagement of the tube 26 with the notches is sufficient to hold the scrubber 22 in engagement with the head through normal vigorous cleaning activity until the scrubber and tube are manually disengaged from the head. In the alternative or in addition the sides 34 and 35 of the cleaning head may be comprised of a sufficiently flexible yet rigid plastic or other material that can bend slightly outward to allow the holder tube 26 to be removed, and then move back to hold the tube in engagement therewith. The relative flexibility of the tube and the side walls will depend on the particular materials and structural configurations used.

The cleaning head sides 34 and 35 of the exemplary embodiment also preferably include small gaskets 38 for maintaining a generally fluid tight seal between the fluid pathway 28 and the holder tube 26, when the holder tube is seated in the holding notches 36. These seals preferably include flexible plastic annular lip structures integrally formed with the side walls 34 and 35. Of course in other embodiments other seals and sealing structures, including removable resilient o-rings, washers or other seal structures may be used.

Figure 5:
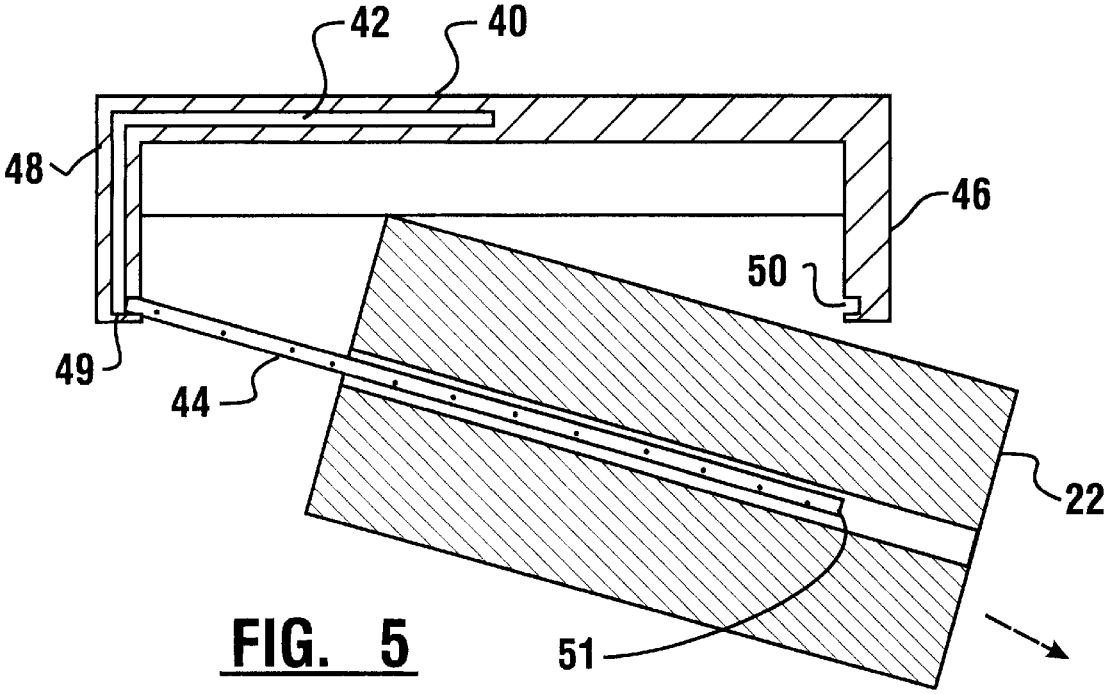
FIG. 5 is representative of an alternative embodiment of the cleaning head in which only a single end of the holder element is disengageable from the cleaning head to allow the scrubber to be removed.

FIG. 5 is representative of an alternative embodiment which includes a cleaning head 40. Here a fluid pathway 42 only passes along one side wall 48 of the cleaning head 40. A first end 49 of the holder tube 44 is in operative connection with side wall 48 and remains in fluid communication with the fluid pathway 42. However, unlike the first described exemplary embodiment, first end 49 is not in releasable connection with side wall 48. Rather first end remains in a fixed connection with side wall 48. A second holder tube end 51 is releasably connected to a side wall 46 in a holding notch 50 similar to that in the first described embodiment.

To remove the scrubber 22, the second holder tube end 51 is disengaged from the holding notch 50 by deforming the tube and/or wall structures. This enables the scrubber 22 to slide away from the holder tube 44. The second holder tube end 51 is preferably closed or otherwise plugged so that fluid will not pass into or leak from the holding notch 50 when the apparatus is in the operative condition and the movable member 20 is pressed. One advantage of this embodiment is that a gasket is not needed between first end 49 of the tube 44 and side wall 48. Further there is less chance of cleaning fluid leaking or of losing the holder tube because the holder tube 44 is always fixed at first end 49 to the cleaning head 40.

Figure 6:
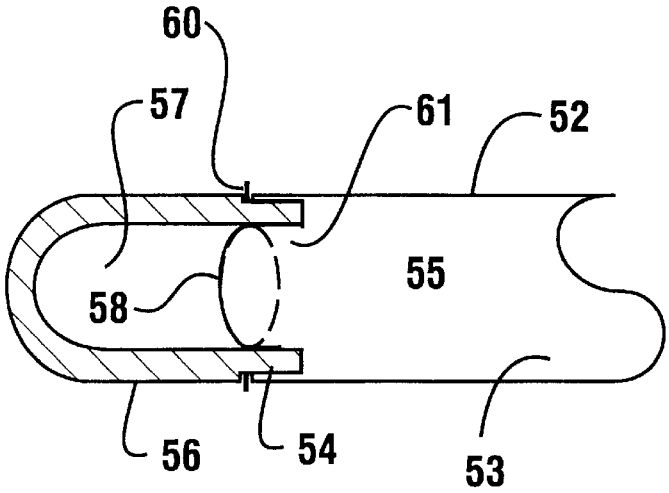
FIG. 6 is representative of an alternative embodiment of the cap which includes the movable member.

FIG. 6 is representative of another alternative exemplary embodiment of the cleaning apparatus of the invention. In this embodiment a movable member 58 is located in a cap 54, rather than in the side of the body as shown in the embodiments described in connection with FIGS. 1 and 2. In this embodiment the cap 54 includes a bore 61 that is covered and bounded by a movable member 58. The bore extends through the cap into connection with the reservoir. The cap 54 in this embodiment includes a loop 56 with an inner diameter 57 that is large enough to allow a finger to pass through the loop 56 and press the movable member 58. The movable member may be a rigid member movable in the bore or may be a flexible member of the type previously described. Of course other types of members capable of pumping fluids may be used.

When the movable member 58 is pressed inward, fluid 55 is forced out of the reservoir 53 and into the pathway that leads to the scrubber. In this exemplary embodiment a valve structure is included to enable air to enter the reservoir as the movable member returns to its outward position. This valve structure preferably includes a check valve structure to prevent the escape of fluid pressure as the button 58 is depressed. In this embodiment air pressure is developed above the liquid that is used as the pumping force for the fluid. Of course in other embodiments the button may be operatively connected to a pumping device which pumps the fluid therethrough directly in response to movable member movement. The cap 54 also includes a gasket 60 which is operative to seal the cap to the body 52 of the cleaning apparatus so that cleaning fluid will not leak from the reservoir.

Figure 7:
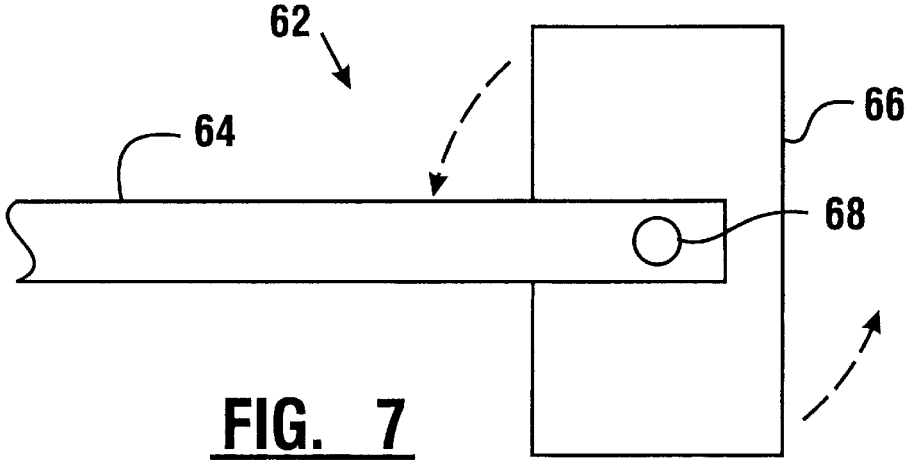
FIG. 7 is representative of an alternative embodiment of the cleaning apparatus in which the cleaning head is operative to turn about a pivot pin in one end of the cleaning apparatus body.
Figure 8:
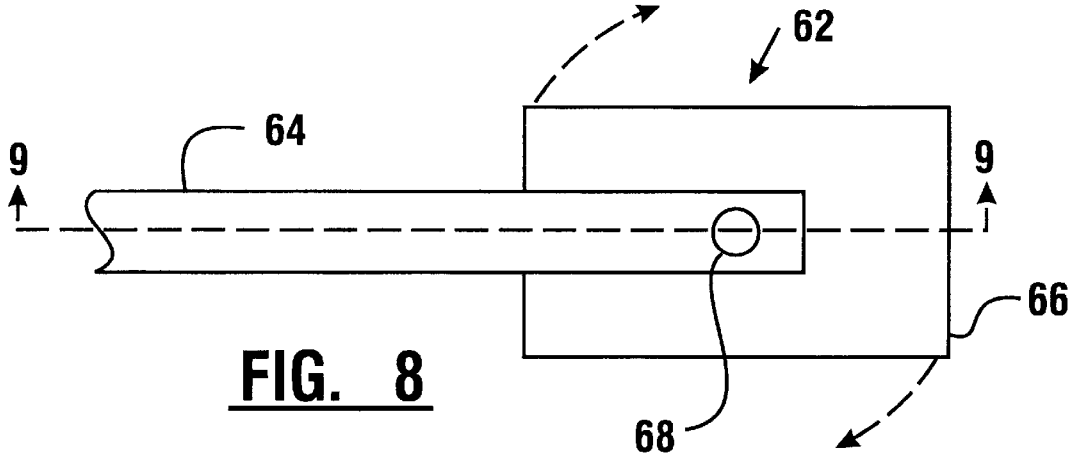
FIG. 8 is representative of an alternative embodiment of the cleaning apparatus in which the pivoted cleaning head has been turned 90 degrees from the angle shown in FIG. 7.

FIGS. 7 and 8 are representative of yet another alternative embodiment of the cleaning apparatus of the invention, generally indicated 62. In this embodiment a cleaning head 66 is rotatable about a pivot pin 68 that extends from the cleaning head into a body 64. The orientation of the head 66 shown in FIG. 7 is useful for cleaning wide surfaces such as a floor or table, whereas the orientation of the head 66 shown in FIG. 8 is useful for narrow cleaning jobs such as the space between a refrigerator and a wall. Turning the cleaning head to the position shown in FIG. 8 is also more useful for storing the apparatus in a narrower space.

Figure 9:
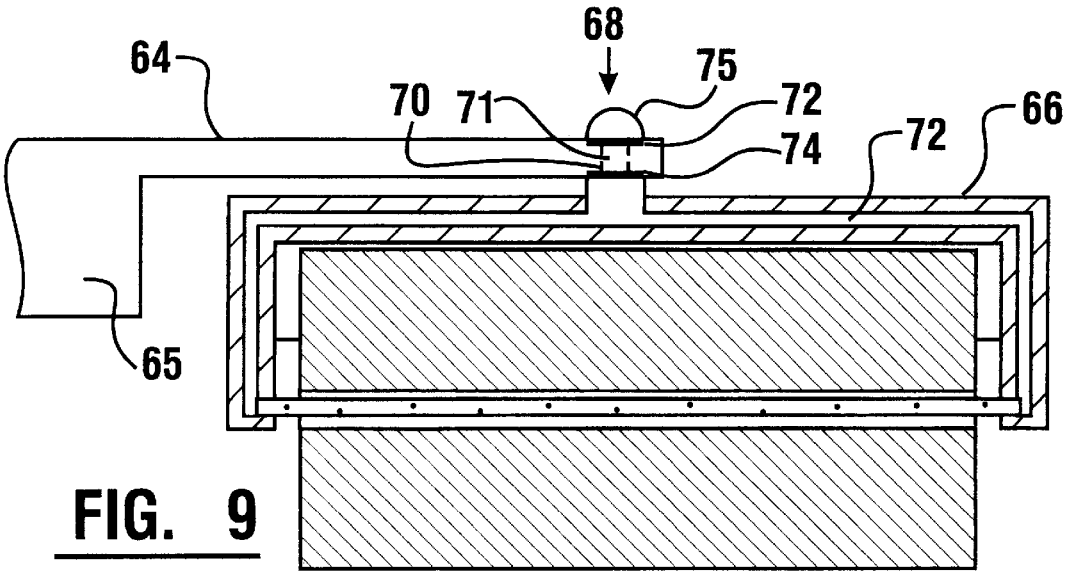
FIG. 9 is a cross-sectional side view representative of the pivoting cleaning head shown in FIGS. 7 and 8.

FIG. 9 is representative of a cross sectional side view of the cleaning head 66 orientated with respect to the body 64 as is shown in FIG. 8. In this exemplary embodiment the pivot pin 68 includes a plurality of apertures 70 that enable fluid 65 in the body 64 to flow into a bore 71 in the pivot pin 68. The bore 71 is in fluid connection with a fluid pathway 72 of the cleaning head 66. This pivot pin also includes gaskets 72 and 74 which are operative to seal the fluid inside the apparatus and to generally prevent leaking of the fluid outside of the apparatus in the area of the pivot pin.

In this embodiment the pivot pin 68 is fixed to the cleaning head 66 and extends through the body 64 of the apparatus. The pivot pin 68 includes a threaded nut 75 which holds the body in rotatable engagement with the pivot pin 68. In alternative embodiments, the pivot pin could be a fixed or internal portion of the body 64 that extends through the cleaning head. In other embodiments the pivot pin may be a separate part about which both the body and the cleaning head freely rotate. The present invention encompasses any means that enables the cleaning head to rotate with respect to the body and that further facilitates fluid transfer between the body and the cleaning head.

The exemplary embodiments of the cleaning apparatus described herein have been described with reference to particular materials and parts. Other embodiments of the invention may include other or different materials and parts which provide similar functions or performance characteristics.

Thus the cleaning apparatus of the present invention achieves the above stated objectives, eliminates difficulties encountered in the use of prior devices and systems, solves problems and attains the desired results described herein.

In the foregoing description certain terms have been used for brevity, clarity and understanding. However, no unnecessary limitations are to be implied therefrom because such terms are for descriptive purposes and are intended to be broadly construed. Moreover the descriptions and illustrations herein are by way of examples and the invention is not limited to the details shown and described.

In the following claims any feature described as a means for performing a function shall be construed as encompassing any means capable of performing the recited function and shall not be deemed limited to the particular means shown in the foregoing description or mere equivalents thereof.

Having described the features, discoveries and principles of the invention, the manner in which it is constructed and operated and the advantages and useful results attained; the new and useful structures, devices, elements, arrangements, parts, combinations, systems, equipment, operations, methods, processes and relationships are set forth in the appended claims.

I claim:

1. A cleaning apparatus comprising:

a body, wherein the body includes a reservoir in supporting connection therewith, wherein the reservoir is enabled to hold a supply of cleaning fluid, wherein the reservoir includes a first opening, and wherein cleaning fluid may be added to the reservoir through the first opening;

a holder tube, wherein the holder tube includes a plurality of apertures wherein the holder tube further includes two ends, wherein each holder tube end is in operative connection with the bode wherein at least one of the holder tube ends is in releasable connection with the body;

a fluid pathway, wherein the fluid pathway is in fluid communication with the reservoir and the holder tube, and wherein the fluid pathway enables fluid to pass from the reservoir to the holder tube;

a scrubber, wherein the scrubber is in fluid communication with the holder tube and wherein the scrubber is in releasable supporting connection with the holder tube, said scrubber having at least one flat surface parallel to said holder tube, wherein when the at least one of the holder tube ends is released from the body, the scrubber is enabled to be released from both the body and the holder tube; and a movable member in operative connection with the reservoir, wherein movement of the movable member is operative to cause fluid to move from the reservoir through the pathway and into the holder tube, whereby fluid from the holder tube is deposited adjacent the scrubber.

2. The cleaning apparatus according to claim 1 wherein the scrubber includes a bore, wherein the scrubber includes two opposed ends wherein each of the opposed ends of the scrubber includes an opening to the bore, wherein the holder tube extends through the bore.

3. The cleaning apparatus according to claim 2, wherein the first holder tube end is in releasable connection with the body, wherein the second holder tube end is in fluid communication with the fluid pathway.

4. The cleaning apparatus according to claim 1 wherein the body includes a second opening into the reservoir, wherein the movable member includes a flexible membrane, and wherein the flexible membrane covers the second opening.

5. The cleaning apparatus according to claim 1 further comprising a cap, wherein the cap is operative to releasably engage the body, wherein the cap is operative to close and fluidly seal the first opening, and wherein the cap includes the movable member.

6. The cleaning apparatus according to claim 5 wherein the cap includes a loop, wherein the cleaning apparatus can be stored by hanging the cleaning apparatus by the loop.

7. The cleaning apparatus according to claim 1, wherein the cleaning fluid in the holder tube is operative to pass through the apertures, wherein the cleaning fluid is deposited adjacent the scrubber.

8. The cleaning apparatus according to claim 1, wherein the scrubber comprises a synthetic sponge.

9. The cleaning apparatus according to claim 1, further comprising an air inlet, wherein the air inlet is operative to normalize the internal pressure of the reservoir with atmospheric pressure.

10. The cleaning apparatus according to claim 1, further comprising a fluid valve, wherein the fluid valve is operative to block cleaning fluid from passing through the pathway when the movable member is not causing fluid to move.

11. The cleaning apparatus according to claim 1, wherein the body has a long cylindrical shape operative to allow a user to grasp and hold the apparatus by the body, wherein the scrubber includes a contact surface, wherein the body extends at an angle to the contact surface for enabling the user to apply sufficient forces to the cleaning apparatus for scrubbing a dirty surface with the contact surface of the scrubber.

12. A cleaning apparatus comprising:

a body wherein the body includes a reservoir in supporting connection therewith, wherein the reservoir is enabled to hold a supply of cleaning fluid, wherein the reservoir includes an opening, and wherein cleaning fluid may be added to the reservoir through the opening;

a cleaning head in operative connection with the bode wherein the cleaning head includes:

a holder tube, wherein the holder tube includes a plurality of apertures, wherein the holder tube is in releasable connection with the cleaning head;

a fluid pathway wherein the fluid pathway is in fluid connection with the reservoir and the holder tube and wherein the fluid pathway enables fluid to pass from the reservoir to the holder tube; and a scrubber, wherein the scrubber is in fluid connection with the holder tube, said scrubber having at least one flat surface parallel to said holder tube, wherein the scrubber includes a bore, wherein the holder tube extends through the bore, and wherein the scrubber is in releasable supporting connection with the holder tube, whereby when the holder tube is released from the cleaning head the scrubber is enabled to be released from the cleaning head; and a movable member in operative connection with the reservoir wherein movement of the movable member is operative to cause fluid to move from the reservoir through the pathway and into the holder tube, whereby fluid from the holder tube is deposited adjacent the scrubber.

13. The cleaning apparatus according to claim 12, wherein the cleaning head includes a pair of opposed sides, wherein the first side includes a first holding notch and wherein the second side includes a second holding notch, wherein both notches are in fluid communication with the pathway, wherein the holder tube has two opposed ends, wherein the first holder tube end is in releasable connection with the first holding notch, and wherein the second holder tube end is in releasable connection with the second holding notch.

14. The cleaning apparatus according to claim 13 wherein at least one of the sides is sufficiently flexible to bend for enabling the holder tube ends to be removed from the holding notches.

15. The cleaning apparatus according to claim 12 wherein the holder tube is sufficiently flexible to bend for enabling the holder tube ends to be removed from the holding notches.

16. A cleaning apparatus comprising:

a body wherein the body includes a reservoir in supporting connection therewith, wherein the reservoir is enabled to hold a supply of cleaning fluid, wherein the reservoir includes an opening, and wherein cleaning fluid may be added to the reservoir through the opening;

a cleaning head in operative connection with the bode wherein the cleaning head includes:

a holder tube, wherein the holder tube includes a plurality of apertures;

a fluid pathway wherein the fluid pathway is in fluid connection with the reservoir and the holder tube, and wherein the fluid pathway enables fluid to pass from the reservoir to the holder tube; and a scrubber wherein the scrubber is in fluid connection with the holder tube; said scrubber having at least one flat surface parallel to said holder tube; and a pivot pin in operative connection between the body and the cleaning head; wherein the cleaning head is operative to rotate about the pivot pin with respect to the body; and a movable member in operative connection with the reservoir, wherein movement of the movable member is operative to cause fluid to move from the reservoir through the pathway and into the holder tube whereby fluid from the holder tube is deposited adjacent the scrubber.

17. The cleaning apparatus according to claim 16, wherein the pivot pin includes a pivot bore, wherein the pivot bore is in fluid communication with both the reservoir and the fluid pathway, wherein cleaning fluid can pass from the reservoir through the pivot bore to the fluid pathway.

18. A cleaning apparatus comprising:

means for storing a supply of cleaning fluid;

means for scrubbing, wherein the scrubbing means is operative to absorb the cleaning fluid;

means for depositing the cleaning fluid adjacent the scrubbing means, wherein the depositing means is in fluid communication with the storing means, and wherein the depositing means includes two opposed ends, wherein each of the depositing means ends is in operative connection with the storing means, wherein at least one of the depositing means ends is in releasable connection with the storing means wherein the scrubbing means is in releasable supporting connection with the depositing means, and wherein when the at least one depositing means end is released from the storing means, the scrubbing means is enabled to be released from the depositing means; and means for pumping the cleaning fluid from the storing means through the depositing means and into the scrubbing means, wherein the pumping means is in operative connection with the storing means; and wherein the depositing means includes a plurality of apertures, wherein the scrubbing means includes a bore, wherein the depositing means is slidably received through the bore, wherein the pumping means is operative to force cleaning fluid through the apertures and into the bore of the scrubbing means.

19. The cleaning apparatus according to claim 18 wherein the depositing means is in pivoting connection with respect to the storage means.

* * * * *